United States Patent [19]

Hall

[11] Patent Number: 4,802,826

[45] Date of Patent: Feb. 7, 1989

[54] SEALED, SELF-CONTAINED, LIQUID-COOLED, GAS COMPRESSOR

[75] Inventor: John M. Hall, Burlingame, Calif.

[73] Assignee: Rix Industries, Emeryville, Calif.

[21] Appl. No.: 392,029

[22] Filed: Jun. 25, 1982

[51] Int. Cl.[4] ..... F04B 39/06; F04B 35/04

[52] U.S. Cl. ..... 417/243; 417/271; 417/367; 417/372

[58] Field of Search ..... 417/243–271, 417/902, 367, 372

[56] References Cited

U.S. PATENT DOCUMENTS

| | | | |
|---|---|---|---|
| 1,760,475 | 5/1930 | Carrier | 417/243 X |
| 2,178,425 | 10/1939 | Johnson | 417/902 X |
| 3,435,775 | 4/1969 | Parrett | 91/501 |
| 3,514,221 | 5/1970 | Hasquenoph et al. | 417/271 X |
| 4,138,203 | 2/1979 | Slack . | |

FOREIGN PATENT DOCUMENTS

| | | | |
|---|---|---|---|
| 2410750 | 3/1979 | France | 417/266 |

*Primary Examiner*—Andrew V. Kundrat
*Assistant Examiner*—Peter M. Cuomo
*Attorney, Agent, or Firm*—Glen R. Grunewald; Thomas R. Lampe

[57] ABSTRACT

A completely sealed, self-contained, liquid-cooled gas compressor is disclosed. It is made up of vertically superimposed and motive power connected electric motor, gas compressor and oil pump coaxially positioned within a vertical sealed cylindrical housing providing an oil sump at its lower end. Heat exchanger tubes are mounted within the oil sump and in an externally mounted heat exchanger for cooling the oil in the sump and cooling compressed gas derived from a series of compressor stages. Cooled oil is caused to continuously flow over the electric motor and compressor to provide cooling and lubrication and sealing of compressor pistons. A special type of axial swash or wobble plate compressor is used to obtain coaxial alignment and direct connection of motor driven shafts.

2 Claims, 2 Drawing Sheets

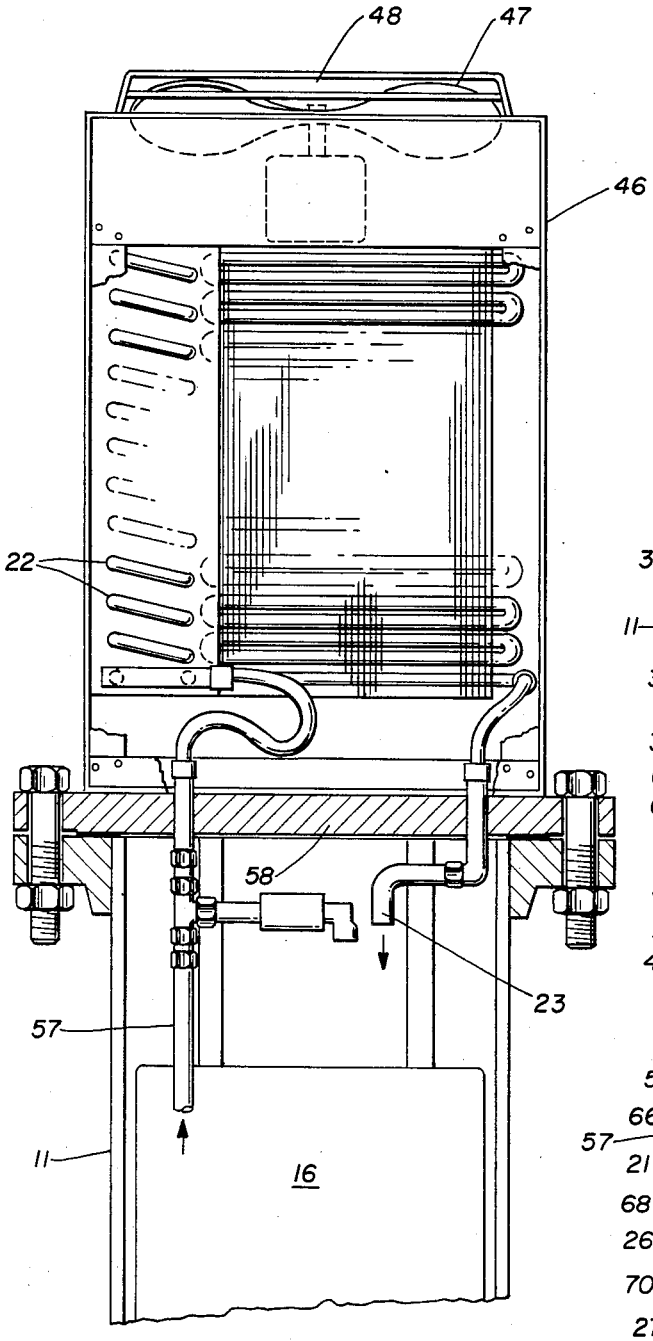
Fig. 2
Fig. 3
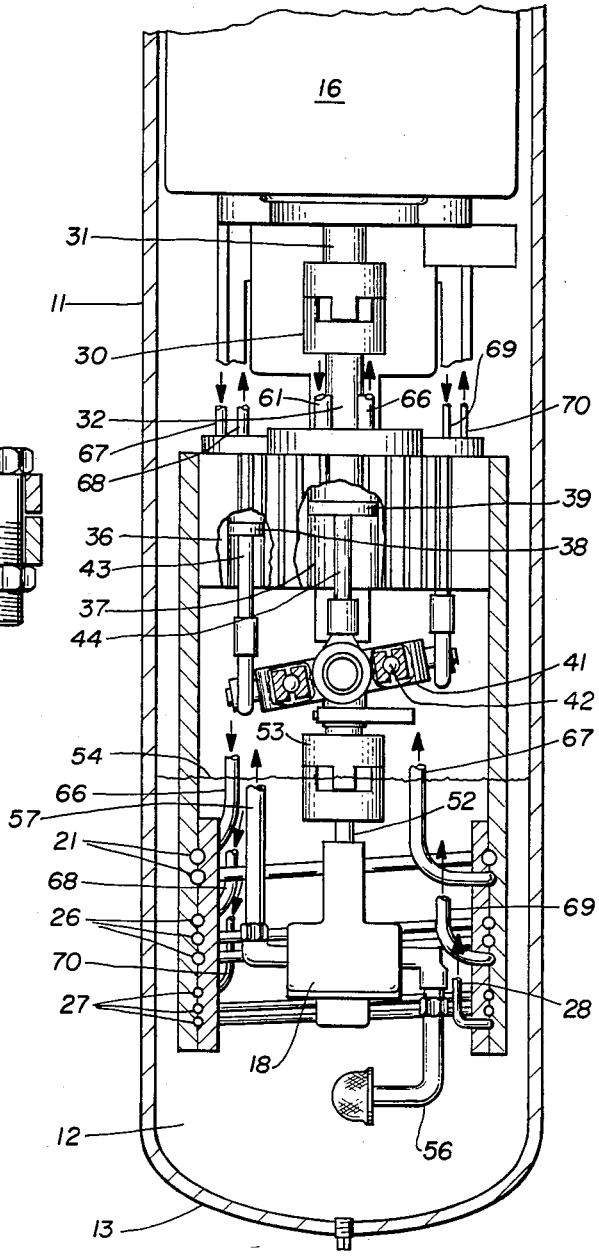

SEALED, SELF-CONTAINED, LIQUID-COOLED, GAS COMPRESSOR

BACKGROUND OF THE INVENTION

In the present critical gasoline shortage, large volumes of natural petroleum gas remain a potential, unused, low-cost, energy source. Natural petroleum gas, essentially methane, burns efficiently and cleanly in an internal combustion engine with virtually no air polution. Natural gas has a high octane rating and can be expected to substantially extend engine life. Natural gas is an uninterruptible fuel available at a cost of about ⅓ to ½ the price of gasoline and is domestically available, not controlled by overseas cartels. Natural gas conversion kits for automotive vehicles are reliable and available at modest cost.

A distribution network is in place for the delivery of natural gas to domestic and industrial users. To make natural gas usable for use in automotive vehicles, however, the gas must be compressed and filled into pressure tanks carried by the vehicles. At present, no small scale machinery or apparatus has been specifically designed and made available at reasonable cost for converting natural gas as available from the gas delivery line at a relatively low pressure of 4 to 6 ounces per square inch to the required elevated pressure for automotive use generally in the range of 2,000 to 3,000 pounds per square inch. Large scale equipment is available, but not practical, for home owners or small businesses.

A prospective user of natural gas in automotive vehicles is presently required to select a number of components of appropriate capacity and engineer an operating assembly. The resulting machine is likely to be unsafe; only poor to modest efficiency; to be noisy; to emit noxious odors; to be ill suited to daily and protracted operation; to substantial maintenance and repair to keep in operation; generally to not be suited for residential installation where night time operation may disturb the rest and sleep of owners and neighbors.

SUMMARY OF THE INVENTION

An object of the present invention to provide a compact, unitary, totally sealed and self-contained liquid-cooled, gas compressor which is specially designed for residential and industrial installations for converting natural gas as it is available from the gas distrib system to a compressed state in storage tanks which may be carried by the automotive vehicles to be fueled by the gas delivered from the tanks.

Another object of the present is to provide a gas compressor unit of the character described which is safe, reliable, economic, and quiet in its operation and which will have the capacity to re-fuel an automotive vehicle in a few off-peak, non-driving, hours.

A further object of the present in is to provide a compressor unit which may be easily and readily installed and connected to available gas distribution lines of residential and industrial users.

Still another object of the present invention is to provide a gas compressor unit which will have a long useful life with minimum maintenance and repair and may be manufactured at modest cost so as to afford the purchaser and user substantial savings in automotive fuel costs.

Widespread adoption and use of the compressor of the present invention will provide a more continuous volume of gas use and reduce heavy seasonal demand swings now experienced by gas utilities.

The invention possesses other objects and features of advantage, some of which of the foregoing will be set forth in the following description of the preferred form of the invention which is illustrated in the drawings accompanying and forming part of this specification. It is to be understood, however, that variations in the showing made by the said drawings and description may be adopted within the scope of the invention as set forth in the claims.

BRIEF DESCRIPTION OF THE DRAWINGS

FIG. 2 is a fragmentary cross-sectional view on a somewhat enlarged scale of a portion of the unit.

FIG. 3 is a fragmentary cross-sectional view on an enlarged scale of another portion of the unit.

DETAILED DESCRIPTION OF THE INVENTION

Figure 1:
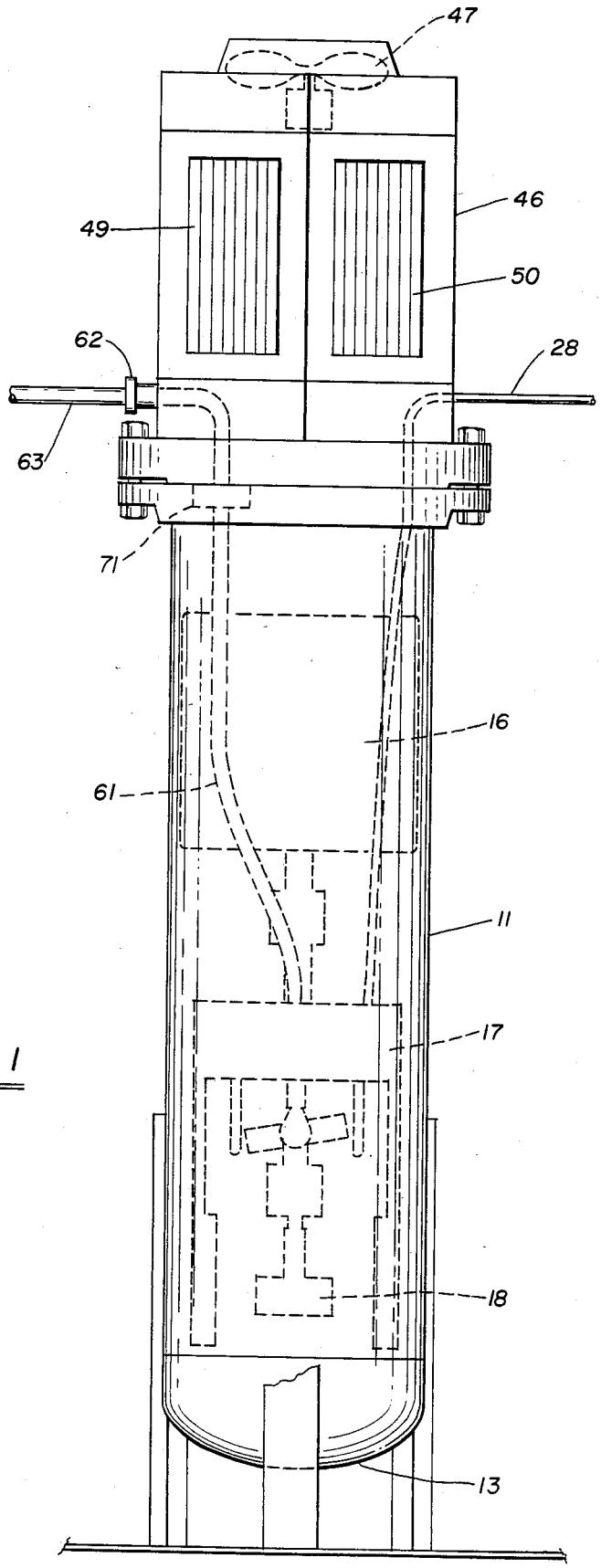
FIG. 1 is a side elevation of a sealed, self-contained, liquid-cooled, gas compressor unit constructed in accordance with the present invention.

The gas compressor unit of the present invention comprises, briefly, an enclosed, sealed, elonoated housing 11 adapted for vertical positioning of its longitudinal axis in use and providing an oil sump 12 at its normally lower end 13; vertically superimposed motive power connected electric motor 16, gas compressor 17, and oil pump 18 positioned within the housing with pump 18 lowermost and having an intake 56 connected to withdraw oil from the sump 12; heat exchanger tubes 21 mounted in housing 11 and within sump 12; additional heat exchanger tubes 22 connected to the discharge of said pump and mounted externally of housing 11 for cooling oil therein and being connected to discharge cooled oil from an open tube end 23 onto motor 16 and the compressor 17 for gravitation thereover and into sump 12; heat exchanger tubes 21 being connected to compressor 17 for cooling gas compressed thereby and being adapted for connection, see conduit 28, to a compressed gas storage tank.

As an important feature of the present unit, use is made of an axial swash or wobble plate compressor of the type disclosed in U.S. Pat. No. 4,138,203. This type of compressor enables a coaxial alignment and a direct connection by coupling 30 of the motor and compressor drive shafts 31 and 32; and the alignment of the parts permits the location of the shafts substantially coaxially of the longitudinal center axis of housing 11. The compressor comprises a plurality of cylinders, two of which 36 and 37 are shown in FIG. 3, having longitudinal axes disposed in circumferentially spaced and substantially parallel relation to compressor shaft 32. Typically three such cylinders of different diameters are symetrically positioned around shaft 32 so as to provide a plurality of stages for successively increasing pressure of the gas being compressed. Pistons, see pistons 38 and 39, are mounted for reciprocation in the cylinders; and a wobble plate 41 is mounted on and generally perpendicularly to the compressor shaft and has a driving connection through a canted bearing 42 to the shaft providing longitudinal undulation of the plate upon rotation of the shaft. The plate is connected by connecting rods, see rods 43 and 44, to the pistons to provide reciprocation thereof in their respective cylinders. As a further feature of the present invention, gas conducting tubes 21, 26 and 27 are connected to conduct a gas from the output of one stage to the input of another and to conduct gas from each stage through sump 12.

As hereinabove noted, oil from sump 12 is pumped by pump 18 to heat exchanger tubes 22 which are here mounted in a fan housing 46 conveniently mounted atop of housing 11. An electric motor driven fan 47 is positioned for discharging air upwardly and out of housing 46 through a top vent 48 thus drawing air through inlet vents 49 and 50 in the side of housing 46 for passage of cool atmospheric air over the heat exchanger tubes 22 deployed in a circuitous form in the airstream for optimum heat transfer and cooling of the oil. As will be best seen from FIG. 3, pump 18 is mounted with its drive shaft 52 connected coaxially by coupling 53 to compressor drive shaft 32 so as to position pump 18 submerged in oil sump 12 below the normal oil level 54 maintained in housing 11. Oil is drawn through pump suction conduit 56 into the intake of pump 18 for discharge via conduit 57 which extends vertically of the unit and through the top 58 of housing 11 to connect to one end of heat exchanger tubes 22. The opposite end 23 of tubes 22 extend back through top 58 for discharge of cooled oil onto the top of the electric motor 16 for bathing the motor, compressor, bearings and other parts with cooled oil and lubricating and sealing the compressor pistons, as the oil returns by gravitation to sump 12.

Housing 11 may be formed of heavy wall pipe as typically used for underground oil and gas transmission lines, and top 58 is preferably formed as a heavy plate bolted and sealed to the top of the housing as illustrated in FIG. 2. The structure thus provides a completely sealed, gas-tight, explosion proof, flame proof structure which contains both the driver and driven components. This feature is particularly important because of the nature of the product being handled, i.e., natural gas and the furnishing of protection against damage or rupture from outside sources. The completely self-contained unit also tends to make it tamper proof and resistant to vandalism. Where feasible, housing 11 may be buried in the ground to provide protection for the unit against the weather and externally caused damage, and to provide quietness of operation. The top mounted heat exchanger is in such installations mounted above ground to provide adequate cooling. Thus mounted, the unit provides a very quiet running, attractive, installation and may be located in patios adjacent to a residence. The vertical orientation of the unit requires a minimum of floor space and facilitates the installation where the unit is buried in the ground for aesthetic and sound proof reasons.

The input of the first stage of the compressor is here connected by a conduit 61 to a fitting 62 adapted for connection by conduit 63 to the utility gas line. The output of the first compressor stage is connected by conduit 66 to one end of heat exchanger coil 21, the other end of the coil being connected by conduit 67 to the input of the second stage of the compressor. The output of the second stage is connected by conduit 68 to a second set of heat exchanger tubes 26 mounted for cooling in oil sump 12. The opposite end of tubes 26 is connected by conduit 69 to the input of the third stage of the compressor; and the output of the third stage is connected by conduit 70 to a third set of heat exchanger tubes 27 in the sump. The opposite end of tubes 27 is connected by conduit 28 which extends from the unit, see FIG. 1, for connection to the gas storage tank being charged. A pressure equalizing device 71 is located in the inlet conduit 61 inside the capsule which allows any piston ring blow-by or relief valve blow-off within the capsule to be drawn back into the compressor inlet and recompressed with the incoming gas, thus avoiding an excessive build-up of pressure in the capsule.

What is claimed is:

1. A sealed, self-contained, liquid-cooled compressor for natural gas comprising:

an enclosed housing providing an elongated, sealed, explosion-proof chamber adapted for vertical positioning of its longitudinal axis in use and providing an oil sump at its normally lower end;

verically superimposed and motive power connected electric motor, multi-stage gas compressor comprising a plurality of stages for successively increasing pressure of gas compressed therein and an oil pump positioned within said housing with said pump lowermost and having an intake connected to withdraw oil from said sump;

a plurality of sets of compressed gas heat exchanger tubes, one set for each stage of said compressor, mounted in said housing within said sump to cool the gas in said tubes; said sets individually connecting the output of each lower stage to the input of the next succeeding stage and the output of the last stage for delivery of compressed gas to a storage tank;

oil heat exchanger tubes connected to the discharge of said pump and mounted externally of said housing for cooling oil therein and being connected to discharge cooled oil onto said motor and compressor for gravitation thereover and into said sump;

a gas inlet conduit connected to the input of the first stage of said compressor; and means mounted interiorly of said chamber and connected to said inlet conduit allowing any inadvertent escaped high pressure gas in said chamber to be drawn back into said compressor, thus avoiding excessive build-up of gas pressure in said chamber.

2. The apparatus of claim 1, said motor and compressor and pump having coaxially aligned and connected drive shafts positioned substantially coaxially of said longitudinal axis of said housing.

* * * * *

UNITED STATES PATENT AND TRADEMARK OFFICE

CERTIFICATE OF CORRECTION

PATENT NO. : 4,802,826
DATED : Feb. 7, 1989
INVENTOR(S) : John M. Hall

It is certified that error appears in the above-identified patent and that said Letters Patent is hereby corrected as shown below:

| | |
|---|---|
| Col. 1, line 36 | insert --have-- before "only poor" |
| Col. 1, line 39 | insert --and-- after "operation" |
| Col. 1, line 44 | insert --is-- after "invention" |
| Col. 1, line 48 | delete "distrib" and insert --distribution-- |
| Col 1, line 52 | insert --invention-- after "present" |
| Col. 1, line 57 | replace "in" with --invention-- |
| Col. 1, line 64 | insert --which-- before "may be" |
| Col. 2, line 26 | replace "elonoated" with --elongated-- |

Col. 1, line 38, insert -- require -- after "to".

Signed and Sealed this

Twelfth Day of September, 1989

*Attest:*

DONALD J. QUIGG

*Attesting Officer*

*Commissioner of Patents and Trademarks*